US009765938B2

(12) United States Patent
Yagi

(10) Patent No.: US 9,765,938 B2
(45) Date of Patent: Sep. 19, 2017

(54) VEHICLE HEADLAMP

(71) Applicant: KOITO MANUFACTURING CO., LTD., Tokyo (JP)

(72) Inventor: Takayuki Yagi, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 281 days.

(21) Appl. No.: 14/493,883

(22) Filed: Sep. 23, 2014

(65) Prior Publication Data

US 2015/0085514 A1 Mar. 26, 2015

(30) Foreign Application Priority Data

Sep. 24, 2013 (JP) ..... 2013-197042

(51) Int. Cl.
*F21S 8/10* (2006.01)
*F21W 101/10* (2006.01)

(52) U.S. Cl.
CPC ..... *F21S 48/1317* (2013.01); *F21S 48/115* (2013.01); *F21S 48/1145* (2013.01);
(Continued)

(58) Field of Classification Search
CPC ..... F21S 48/1757; F21S 48/1388; F21W 2101/10; G02B 26/0833; G02B 27/0933
See application file for complete search history.

(56) References Cited

U.S. PATENT DOCUMENTS 5,938,319 A 8/1999 Hege
6,962,419 B2 * 11/2005 Huibers ..... H04N 5/7458 348/771

(Continued)

FOREIGN PATENT DOCUMENTS

CN 102478190 A 5/2012
CN 102939500 A 2/2013

(Continued)

OTHER PUBLICATIONS

Communication dated Apr. 1, 2016 issued by State Intellectual Property Office of P.R.C. in counterpart Chinese Application No. 201410495914.X.

(Continued)

*Primary Examiner* — Anh Mai
*Assistant Examiner* — Zachary J Snyder
(74) *Attorney, Agent, or Firm* — Sughrue Mion, PLLC

(57) ABSTRACT

A vehicle headlamp includes a light source, a projection optical member, and a light deflector. The projection optical member projects incident light ahead. The light deflector is disposed on an optical axis of the projection optical member and includes plural optical devices which are individually switchable between (i) a first state in which light emitted from the light source is reflected to a direction other than a direction toward the projection optical member and (ii) a second state in which the emitted light is reflected toward the projection optical member. An angle between a normal line to a center portion of each optical device when each optical device is in the first state and the optical axis is smaller than that between a normal line to the center portion of each optical device when each optical device is in the second state and the optical axis.

4 Claims, 7 Drawing Sheets

(52) U.S. Cl.
CPC ..... *F21S 48/1388* (2013.01); *F21S 48/1757* (2013.01); *F21W 2101/10* (2013.01)

(56) References Cited

U.S. PATENT DOCUMENTS

| | | | | |
|---|---|---|---|---|
| 8,602,618 | B2 | 12/2013 | Ahn et al. | |
| 2002/0196636 | A1* | 12/2002 | Dassanayake | B60Q 1/085 362/465 |
| 2003/0202259 | A1* | 10/2003 | Nishimae | G02B 26/008 359/726 |
| 2004/0189447 | A1 | 9/2004 | Okubo et al. | |
| 2004/0218401 | A1 | 11/2004 | Okubo et al. | |
| 2005/0286106 | A1* | 12/2005 | Kimura | G02B 26/0891 359/237 |
| 2007/0024549 | A1* | 2/2007 | Choi | B81B 7/0067 345/84 |
| 2009/0009851 | A1* | 1/2009 | Endo | G02B 26/0841 359/292 |
| 2013/0058114 | A1 | 3/2013 | Reiners | |
| 2013/0094235 | A1 | 4/2013 | Sugiyama et al. | |
| 2014/0192547 | A1* | 7/2014 | Kumar | B60Q 1/00 362/522 |
| 2014/0340909 | A1 | 11/2014 | Yagi | |
| 2015/0124468 | A1 | 5/2015 | Reiners | |
| 2015/0377447 | A1 | 12/2015 | Sugiyama et al. | |

FOREIGN PATENT DOCUMENTS

| | | | |
|---|---|---|---|
| CN | 104141925 | A | 11/2014 |
| JP | 9-104288 | A | 4/1997 |
| JP | 2004-210131 | A | 7/2004 |
| JP | 2010-205418 | A | 9/2010 |
| JP | 2013-182837 | A | 9/2013 |

OTHER PUBLICATIONS

Communication dated May 16, 2017, issued by the Japanese Patent Office in counterpart Japanese Patent Application No. 2013-197042.

* cited by examiner

VEHICLE HEADLAMP

CROSS REFERENCE TO RELATED APPLICATION(S)

This application is based on and claims priority under 35 U.S.C. §119 to Japanese Patent Application No. 2013-197042 (filed on Sep. 24, 2013), the entire contents of which are incorporated herein by reference.

BACKGROUND

Field

Exemplary embodiments relate to a vehicle headlamp that employs a light deflector.

Related Art

One light deflector is provided with the large number of micro-mirror devices each of which is tiltable. Tilt angles of the micro-mirror devices are digitally switched between a first tilt angle and a second tilt angle, so that a reflection direction of light from a light source can be changed appropriately between a first reflection direction (that is, the micro-mirror devices are turned ON) and a second reflection direction (that is, the micro-mirror devices are turned OFF).

JP H09-104288 A (corresponding to U.S. Pat. No. 5,938,319) describes a vehicle lighting device including a reflective light deflector that is disposed on a light path of reflected light from at least one light source. The light deflector can reflect light that hits the light deflector so as to form light flux that are emitted from the lighting device.

SUMMARY

In a lamp unit that uses a light deflector such as one described above, when the micro-mirror devices are turned ON, a reflection direction of light faces more upward than an optical axis of a projection optical member. Therefore, less light flux would be incident in the vicinity of the optical axis of the projection optical member, and a central light intensity of a light distribution pattern would be insufficient.

In view of the above circumstances, one exemplary embodiment of the invention provides technology that adjusts a direction of light reflected by a light deflector in a vehicle headlamp that employs the light deflector so as to enhance the central light intensity of a light distribution pattern projected by a projection optical member.

(1) A vehicle headlamp includes a light source, a projection optical member, and a light deflector. The projection optical member projects light, which is incident thereon, ahead of a lamp unit. The light deflector is disposed on an optical axis of the projection optical member and includes a plurality of optical devices which are arrayed and which are individually switchable between (i) a first state in which light emitted from the light source is reflected to a direction other than a direction toward the projection optical member and (ii) a second state in which the light emitted from the light source is reflected toward the projection optical member. An angle between a normal line to a center portion of each optical device when each optical device is in the first state and the optical axis of the projection optical member is smaller than an angle between a normal line to the center portion of each optical device when each optical device is in the second state and the optical axis of the projection optical member.

The configuration that each optical device of the light deflector is disposed as described above can increase a light flux which is incident in the vicinity of the optical axis of the projection optical member when the light deflector is in the second state. As a result, the central light intensity of the light distribution pattern projected from the projection optical member can be increased, which is advantageous in a case where the vehicle headlamps form a high beam and in a case where the ADB (Adaptive Driving Beam) is executed.

(2) In the vehicle headlamp of (1), a length of the projection optical member in a first direction in which the light reflected by the optical devices moves when the optical devices are switched between the first state and the second state may be shorter than that of the projection optical member in a second direction that is perpendicular to the first direction.

With this configuration, a width of the projection optical member in right and left directions can be made large, and the central light intensity of the light distribution pattern projected from the projection optical member can be increased.

(3) In the vehicle headlamp of any one of (1) to (2), the light source may be disposed below the optical axis of the projection optical member.

(4) The vehicle headlamp of any one of (1) to (3) may further include a reflective optical member. The reflective optical member is disposed below the optical axis of the projection optical member and reflects the light emitted from the light source toward the light deflector. The reflective optical member is closer to the light deflector than the projection optical member.

The configuration that the reflective optical member is provided near the light source can focus the emitted light flux and further enhance the central light intensity of the light distribution pattern projected from the projection optical member.

According to the above described configuration, the direction of the light reflected by the light deflector can be adjusted in the vehicle headlamp employing the light deflector, so as to enhance the central light intensity of the light distribution pattern projected from the projection optical member.

BRIEF DESCRIPTION OF THE DRAWINGS

FIG. 4 illustrates a position of a mirror device in the vehicle headlamp of the related art when the micro-mirror device is turned OFF and a position of the micro-mirror device when the micro-mirror device is turned ON;

FIG. 7A and FIG. 7B illustrate a position of a mirror device in the vehicle headlamp according to the exemplary embodiment of the invention when the micro-mirror device is turned OFF and a position of the micro-mirror device when the micro-mirror device is turned ON;

DETAILED DESCRIPTION

Figure 1:
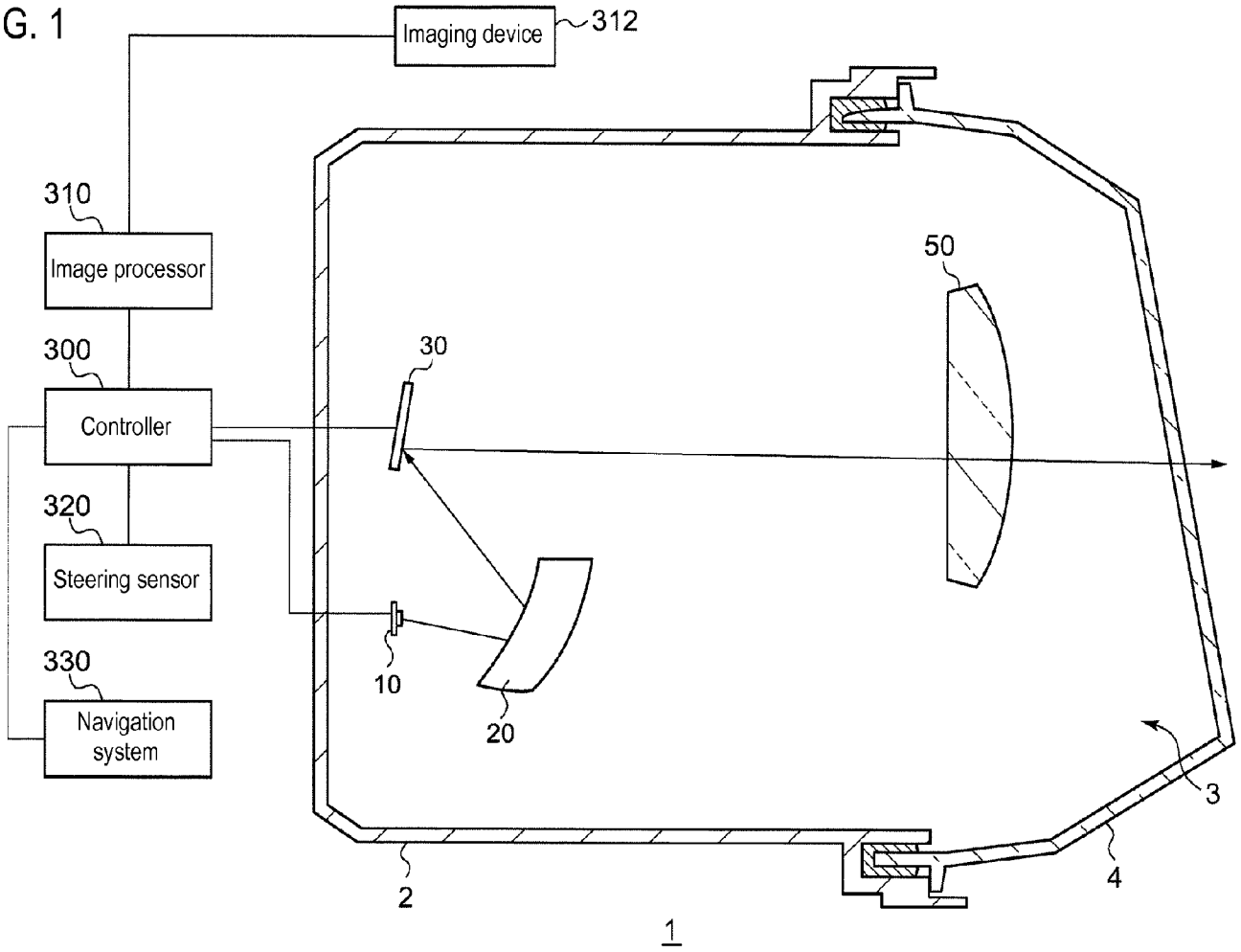
FIG. 1 is a vertical section view illustrating a schematic structure of a vehicle headlamp according to one exemplary embodiment of the invention.
Figure 2:
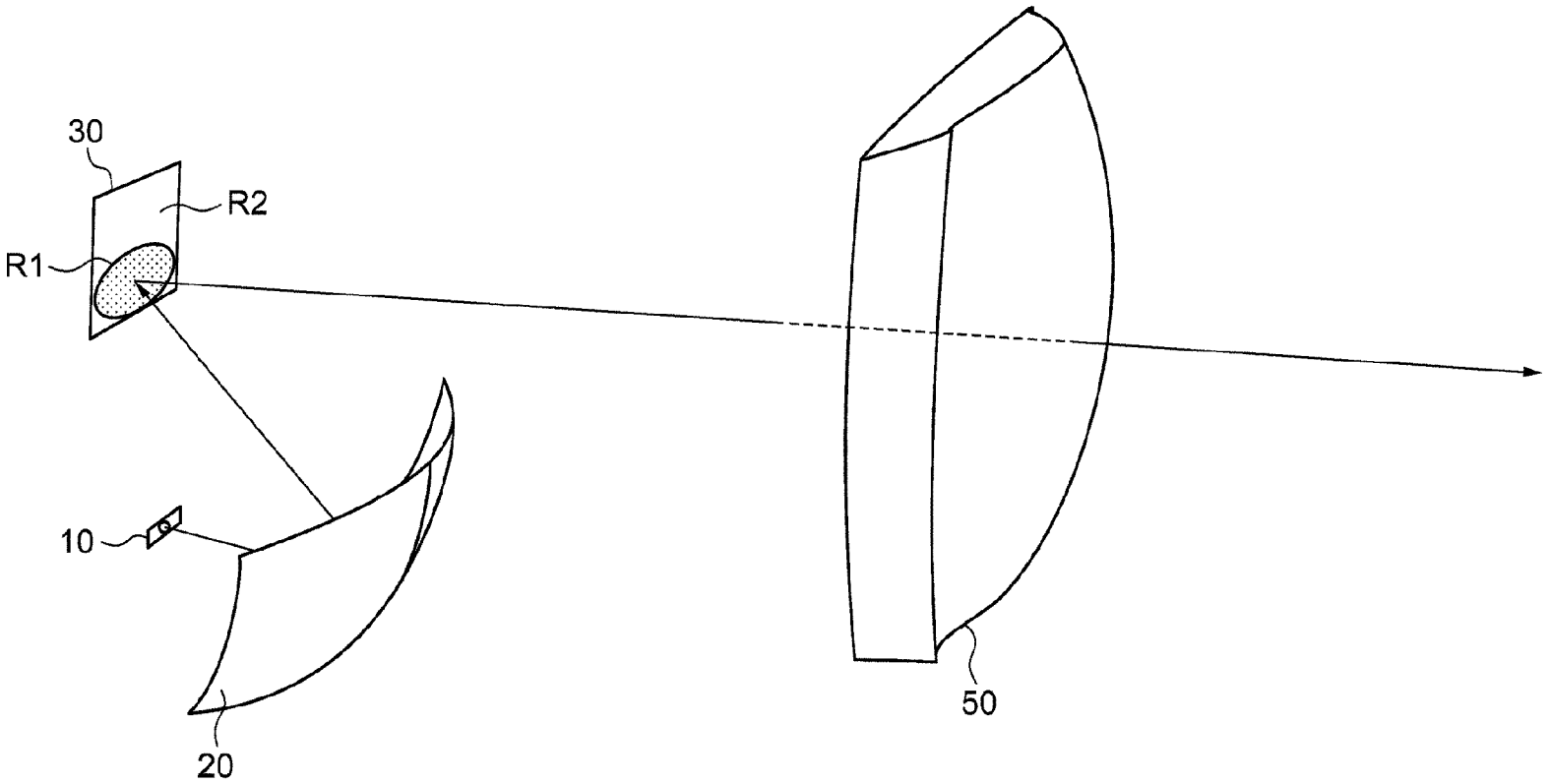
FIG. 2 is a perspective view schematically illustrating an internal structure of the vehicle headlamp.

FIG. 1 is a vertical section view illustrating a schematic structure of a vehicle headlamp 1 according to one exemplary embodiment of the invention. FIG. 2 is a perspective view schematically illustrating an internal structure of the vehicle headlamp 1. The vehicle headlamp 1 is disposed on each of the left and right sides in a front part of a vehicle. It is noted that the left and right vehicle headlamps have substantially the same configuration, except that a part of their components have left-right symmetry structures with respect to each other.

The vehicle headlamp 1 includes a lamp body 2 formed with an opening portion on a vehicle front side, and a translucent cover 4 that is attached so as to cover the opening portion of the lamp body 2. The translucent cover 4 is made of a translucent resin, glass, or the like. The lamp body 2 and the translucent cover 4 make up a lamp chamber 3. The lamp chamber 3 houses a light source 10, a reflective optical member 20, a light deflector 30 and a projection optical member 50. Each component is attached to the lamp body 2 by a support mechanism (not shown).

Examples of the light source 10 include a semiconductor light emitting device such as an LED (light emitting diode), an LD (laser diode), and an EL (electroluminescence) device, a light bulb, an incandescent lamp (a halogen lamp), and an electric discharge lamp (a discharge lamp).

The reflective optical member 20 is configured so as to guide light emitted from the light source 10 to a reflection surface of the light deflector 30. Examples of the reflective optical member 20 include a solid light guide body having a projectile shape and a reflective mirror whose inner surface is formed into a specific reflection surface. It is noted that in a case where light emitted from the light source 10 is directly guided to the reflection surface of the light deflector 30, the reflective optical member 20 may not be provided.

The light deflector 30 is disposed on an optical axis of the projection optical member 50. The light deflector 30 is configured so as to selectively reflect light emitted from the light source 10, to the projection optical member 50. The light deflector 30 is, for example, a MEMS (Micro Electro Mechanical System) or a DMD (Digital Mirror Device), in which a plurality of micro-mirrors are arrayed in an array (matrix) shape. A reflection direction of the light emitted from the light source 10 can be selectively changed by controlling an angle of a reflection surface of each micro-mirror. Namely, a portion of the light emitted from the light source 10 can be reflected toward the projection optical member 50, and the remaining light can be reflected in a direction other than a direction toward the projection optical member 50.

Figure 3:
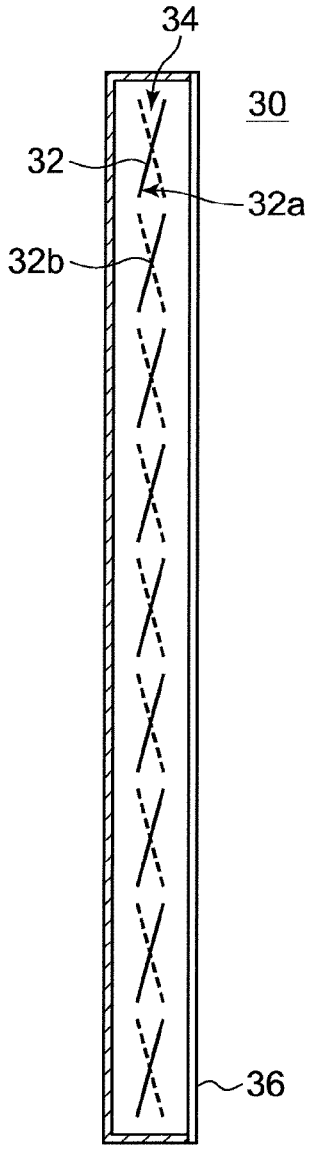
FIG. 3 is a schematic section view of a light deflector in a vehicle headlamp of a related art.

FIG. 3 is a schematic section view of the light deflector 30. The light deflector 30 includes a micro-mirror array 34 and a transparent cover member 36. In the micro-mirror array 34, plural micro mirror devices 32 are arrayed in a matrix manner. The transparent cover member 36 is disposed on the front side (the right side in FIG. 3) of reflection surfaces 32*a* of the micro-mirror devices 32. Each mirror device 32 is formed in a substantially square shape. Each mirror device 32 includes a pivot shaft 32*b* that extends in a horizontal direction and that substantially bisects the micro-mirror device 32.

The micro-mirror devices 32 of the micro-mirror array 34 are configured so as to be individually switchable between (i) a first state (OFF state; represented by dotted lines in FIG. 3) and (ii) a second state (ON state; represented by solid lines in FIG. 3). When the micro-mirror device 32 is in the first state (OFF state), the micro-mirror device 32 reflects the light emitted from the light source to a direction other than a direction toward the projection optical member. When the micro-mirror device 32 is in the second state (ON state), the micro-mirror device 32 reflects the light emitted from the light source toward the projection optical member.

Referring back to FIG. 1, the projection optical member 50 is formed, for example, of a free-form surface lens having a front side surface and a rear side surface which are formed in free-form surface shapes. The projection optical member 50 projects a light source image, which is formed on a rear focal plane including a rear focal point of the projection optical member 50, onto a virtual vertical screen ahead of the lamp unit as an inverted image. The projection optical member 50 is disposed so that the rear focal point of the projection optical member 50 is positioned on the optical axis of the vehicle headlamp 1 and near the reflective surfaces of the micro-mirror array 34 of the light deflector 30. It is noted that the projection optical member 50 may be a reflector.

Referring to FIG. 2, the light emitted from the light source 10 is reflected by the reflective optical member 20, and illuminates the micro-mirror array of the light deflector 30. The incident light illuminates the light deflector 30 with a certain distribution. Thus, as shown in FIG. 2, an illuminance distribution including a first illuminance region R1 and a second illuminance region R2 is formed on the light deflector. The first illuminance region R1 is illuminated with the incident light. The second illuminance region R2 is effectively not illuminated with the incident light.

The light deflector 30 can form a specific light distribution pattern by (i) placing a part of the micro-mirror devices overlapping the first illuminance region R1 to be in an illumination state (for example, in the ON state), to thereby output light for formation of a light distribution pattern toward the front of the lamp unit and (ii) placing the remaining mirror devices overlapping the first illuminance region R1 to be in a non-illumination state (for example, in the OFF state). Examples of the light distribution patterns formed by the vehicle headlamp 1 will be described later with reference to FIGS. 9A to 9C.

A controller 300 adjusts an emission strength of the light source 10 and executes ON/OFF control of each mirror device of the light deflector 30. The hardware configuration of the controller 300 is realized by devices and circuits such as a CPU and a memory of a computer. Also, the software configuration of the controller 300 is realized by a computer program or the like. It is noted that although the controller 300 is provided outside the lamp chamber 3 in FIG. 1, the controller 300 may be provided inside the lamp chamber 3. The controller 300 receives signals from an image processor 310 connected to an imaging device 312, a steering sensor 320, a navigation system 330, and a light switch (not shown), etc. The controller 300 then transmits various control signals to the light source 10 and the light deflector 30 in response to the received signals.

Figure 4:
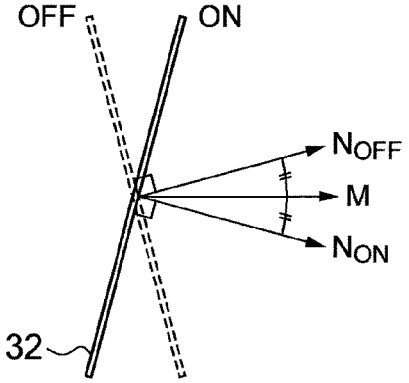

FIG. 4 illustrates an OFF position (shown by dotted lines) and an ON position (shown by solid lines) of each micro-mirror device 32 in the vehicle headlamp of the related art which is disposed so that a longitudinal direction of the light deflector 30 extends substantially vertically. The vertical direction is, for example, perpendicular to (i) the horizontal direction in which the shaft 32*b* of each micro-mirror device 32 extends and (ii) an optical axis X of the projection optical member. As can be seen from FIG. 4, in the related-art configuration, the OFF position and the ON position of each micro-mirror device 32 are symmetrical to each other about a vertical axis. In other words, a bisector M of (i) a normal line $N_{OFF}$ to a center portion of the micro-mirror device 32 when the micro-mirror deice 32 is turned OFF and (ii) a normal line $N_{ON}$ to the center portion of the micro-mirror device 32 when the micro-mirror device 32 is turned ON is substantially parallel to the optical axis X of the projection optical member.

Figure 5A:
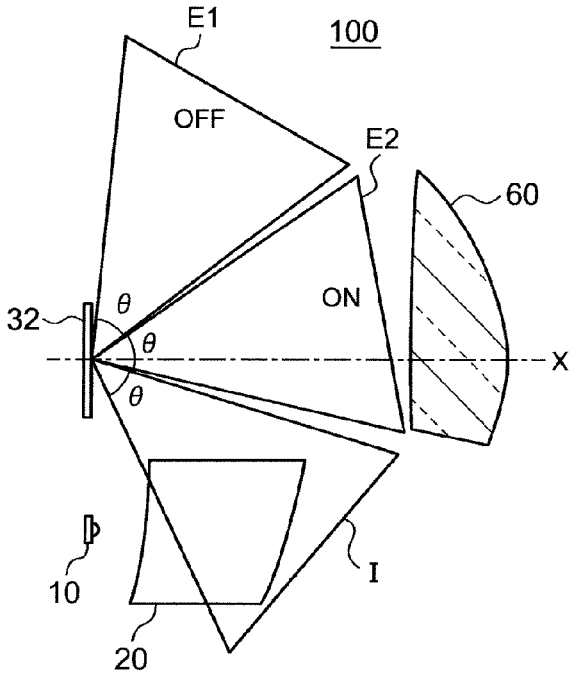
FIG. 5A schematically illustrates spread of incident light and spread of reflected light in the vehicle headlamp of the related art.

FIG. 5A schematically illustrates spread of incident light and spread of reflected light in the vehicle headlamp of the related art. FIG. 5A schematically illustrates (i) the spread of the incident light I, which is emitted by a light source 10, is reflected by the reflective optical member 20, and is then incident to the micro-mirror array 34, (ii) spread of reflected light E1 which is reflected by the micro-mirror array 34 when the micro-mirror devices 32 are turned OFF, and (iii) spread of reflected light E2 which is reflected by the micro-mirror array 34 when the micro-mirror devices 32 are turned ON. It is noted that for the purpose of simplicity of illustration, the micro-mirror array 34 is substituted by a single micro-mirror device 32 in FIG. 5A.

The light emitted from the light source 10 is reflected by the reflective optical member 20. Therefore, the incident light I does not form a completely parallel beam. That is, incident angles of the incident light I to the reflection surfaces 32*a* of the micro-mirror devices 32 have a certain degree of distribution. Also, the micro-mirror devices 32 are disposed so that (i) when the micro-mirror devices 32 located at the OFF positions reflect the incident light I, the reflected light E1 is not directed toward a projection optical member 60, and (ii) when the micro-mirror devices 32 located at the ON positions reflect the incident light I, the reflected light E2 is directed toward the projection optical member 60.

Figure 5B:
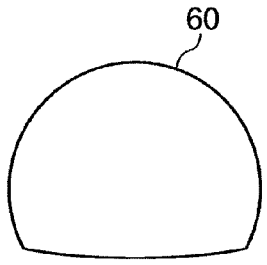
FIG. 5B is a front view of a projection optical member.

As illustrated in FIG. 5A, in the configuration of the vehicle headlamp of the related art, the reflected light E2 which is reflected by the micro-mirror devices 32 located at the ON positions is directed slightly above the optical axis X of the projection optical member 60. Therefore, less light flux is incident in the vicinity of the optical axis of the projection optical member. Furthermore, a lower side portion of the projection optical member cannot be utilized effectively. As shown in FIG. 5B (a front view of the projection optical member 60), a lower side portion of the projection optical member 60 may be cut off in the related art.

If less light flux is incident in the vicinity of the optical axis of the projection optical member, a central light intensity (light intensity in the vicinity of an intersection between a horizontal line and a vertical line on a virtual vertical screen) might be insufficient. The central light intensity is one of important factors in a case where a high beam light distribution pattern is formed by vehicle headlamps and in a case where the ADB (Adaptive Driving Beam) is executed which controls a light distribution pattern in response to positions of forward vehicles such as an oncoming vehicle and a preceding vehicle.

Figure 6:
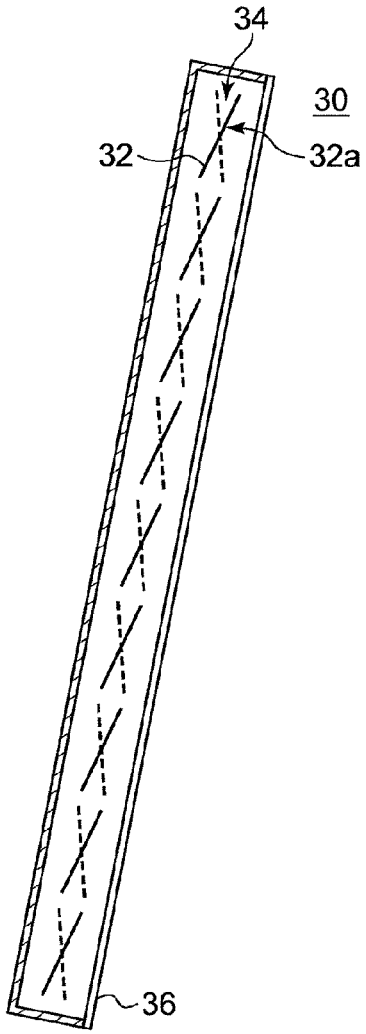
FIG. 6 is schematic section view of a light deflector in a vehicle headlamp according to one exemplary embodiment of the invention.

Then, in this exemplary embodiment, as shown in FIG. 6, the light deflector 30 is inclined so that the front cover member 36 faces slightly downward. Specific description in this regard will be made below with reference to FIG. 7.

Figure 7A:
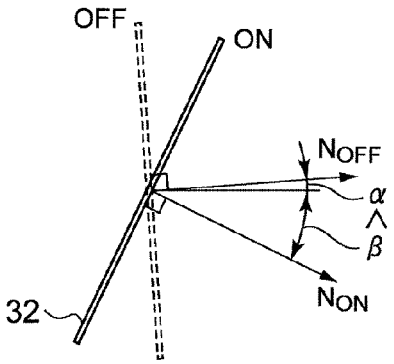
Figure 7B:
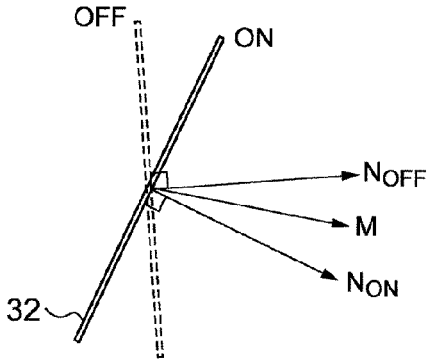

FIG. 7A illustrates an OFF position (shown by dotted lines) and an ON position (shown by solid lines) of each micro-mirror device 32 in the vehicle headlamp according to this exemplary embodiment. As illustrated, the light deflector 30 is inclined so that an angle α between the normal line $N_{OFF}$ to the center portion of the micro-mirror device 32 when the micro-mirror device 32 is turned OFF and the optical axis X (or a line parallel thereto) of the projection optical member 50 is smaller than an angle β between the normal line $N_{ON}$ to the center portion of the micro-mirror device 32 when the micro-mirror device 32 is turned ON and the optical axis X (or a line parallel thereto). In other words, as illustrated in FIG. 7B, the bisector M of an angle formed by the normal line $N_{OFF}$ to the micro-mirror device 32 when the micro-mirror device 32 is turned OFF and the normal line $N_{ON}$ to the micro-mirror device 32 when the micro-mirror device 32 is turned ON includes a downward-facing component with respect to the optical axis X of the projection optical member 50.

Figure 8A:
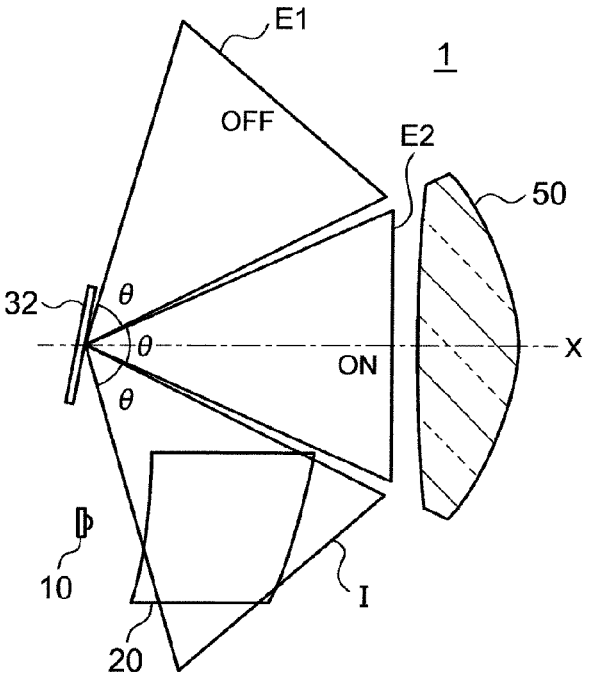
FIG. 8A schematically illustrates spread of incident light and spread of reflected light in the vehicle headlamp according to the exemplary embodiment of the invention.

FIG. 8A schematically illustrates spread of incident light and spread of reflected light in the vehicle headlamp according to this exemplary embodiment. Similarly to FIG. 5A, FIG. 8A schematically illustrates (i) the spread of the incident light I, which is emitted by the light source 10, is reflected by the reflective optical member 20, and is incident to the micro-mirror array 34, (ii) the spread of the reflected light E1 which is reflected by the micro-mirror array 34 when the micro-mirror devices 32 are turned OFF, and (iii) the spread of the reflected light E2 which is reflected by the micro-mirror array 34 when the micro-mirror devices 32 are turned ON. It is noted that for the sake of simplicity of illustration, the micro-mirror array 34 is substituted by a single mirror device 32 in FIG. 8A.

The light deflector 30 is inclined so as to face downward as illustrated in FIG. 8A. Thereby, it becomes possible to direct a center of the spread of the reflected light E2 when the micro-mirror devices 32 are turned ON, toward the optical axis X of the projection optical member 50. Thus, the light flux which is incident in the vicinity of the optical axis X of the projection optical member 50 can be increased. As a result, the central light intensity of the light distribution pattern projected from the projection optical member 50 can be increased, which is advantageous in a case where a high beam is formed by the vehicle headlamps and in a case where the ADB (Adaptive Driving Beam) is executed.

Moreover, the reflected light E2 when the micro-mirror devices 32 are turned ON can spread equally in up and down directions with respect to the projection optical member 50. Therefore, as shown in FIG. 8B (a front view of the projection optical member 50), the projection optical member 50 can be made larger than before.

Furthermore, the light deflector 30 is inclined so as to face downward. Thereby, of the micro-mirror devices making up the micro mirror array, the micro-mirror devices that form the lower side of the light distribution pattern follow a field curvature of the projection optical member. As a result, it becomes easier to focus an image on the lower side of the light distribution pattern, that is, on a road surface side, and a clear light-and-dark distribution be formed on the road surface.

Figure 8B:
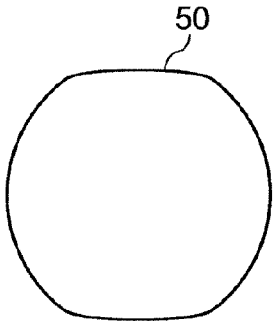
FIG. 8B is a front view of a projection optical member.

It is preferable that a length of the projection optical member 50 in a direction (for example, the up and down directions in FIG. 8B in this exemplary embodiment) in which light reflected by the micro-mirror devices move when the micro-mirror devices 32 of the light deflector 30 are switched between the OFF state and the ON state is shorter than that of the projection optical member 50 in a direction orthogonal to this direction (for example, right and left directions in FIG. 8B in this exemplary embodiment). With this configuration, it can be prevented that the reflected light is incident on the projection optical member 50 when the micro-mirror devices 32 are turned OFF, and the central light intensity of the projected light distribution pattern can be further increased.

In this exemplary embodiment, the light source 10 and the reflective optical member 20 are both disposed below the optical axis X of the projection optical member 50, and the reflective optical member 20 is disposed so as to be closer to the light source 10 and the light deflector 30 than the projection optical member 50. The configuration that the reflective optical member is disposed near the light source can condense a light flux emitted from the reflective optical member. For example, in a case where the light source 10 is a flat surface light source having a rectangular shape, the emitted light flux can be kept within ±30° in the up and down directions and within ±50° in the right and left directions, with respect to the normal line to the light emitting surface of the light source 10. This configuration can further increase the central light intensity of the light distribution pattern projected by the projection optical member.

Figure 9A:
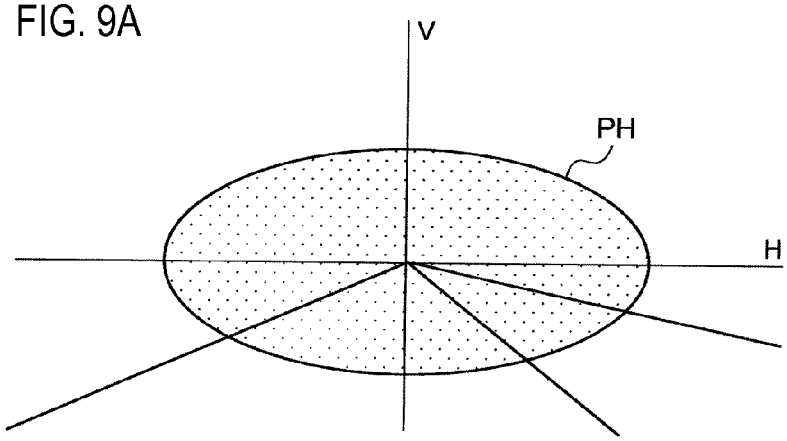
FIGS. 9A to 9C schematically illustrate examples of light distribution patterns formed by the vehicle headlamp according to the exemplary embodiment of the invention.
Figure 9B:
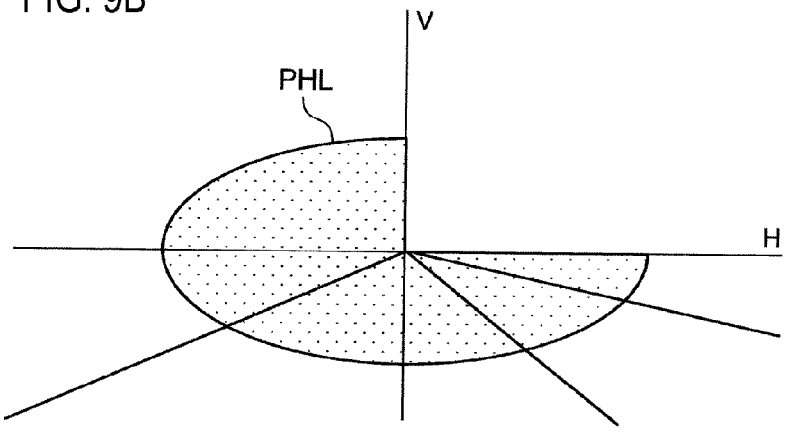
Figure 9C:
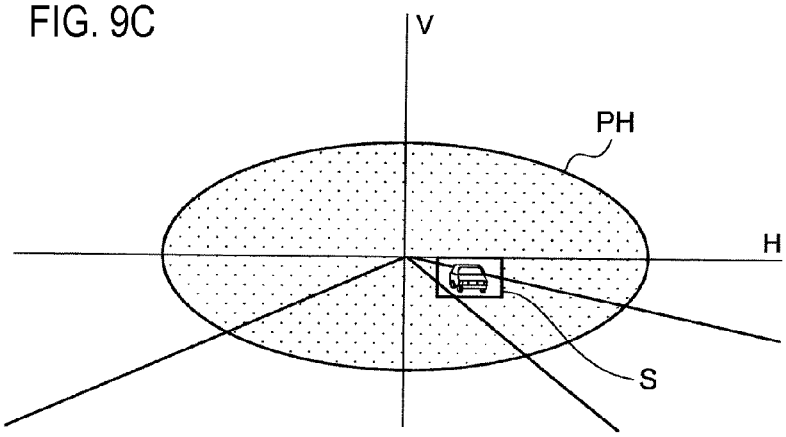

FIG. 9A to 9C are schematic views illustrating examples of light distribution patterns formed by the vehicle headlamp 1 according to this exemplary embodiment. FIGS. 9A to 9C show the light distribution patterns formed on the virtual vertical screen disposed at a predetermined position ahead (for example, 25 m ahead) of the lamp unit.

As shown in FIG. 2, the first illuminance region R1 having a substantially elliptical shape is formed on the light deflector 30. The micro-mirror devices which overlap the first illuminance region R1 are placed in the illumination state (for example, the ON state), and light forming the first illuminance region R1 is illuminated ahead of the lamp unit through the projection optical member 50. Thereby, a high beam light distribution pattern PH having a substantially elliptical shape is formed as shown in FIG. 9A. Namely, the first illuminance region R1 and the high beam light distribution pattern PH have a substantially similar shape to each other. The light deflector 30 may perform a process for clarifying an outline of the high beam light distribution pattern PH by placing the micro-mirror devices located at a peripheral edge portion among the micro-mirror devices overlapping the first illuminance region R1, in the non-illuminated state (for example, the OFF state). Since the shape of the high beam light distribution pattern PH is known, detailed description thereon will be omitted.

The vehicle headlamp 1 can form a light distribution pattern having a desired shape by placing a portion of the micro-mirror devices overlapping the first illuminance region R1 in the illumination state (for example, the ON state) and by placing the remaining portion of the overlapping micro-mirror devices in the non-illumination state (for example, the OFF state). For example, as shown in FIG. 9B, the vehicle headlamp 1 may form a so-called left-side high light distribution pattern PHL including (i) a light illuminance region on a left side and above the horizontal line H and (ii) a light shielded region on a right side and above the horizon line H. Also, the vehicle headlamp 1 may form not only the left-side high light distribution pattern PHL but also a right-side high light distribution pattern, a low beam light distribution pattern, or a so-called split light distribution pattern. The split light distribution pattern includes, for example, a light shielded region at a center portion above the horizon line H and illumination regions on both sides, in the horizontal direction, of the light shielded region.

As shown in FIG. 9C, the vehicle headlamp 1 may form a light shielded region S at a region which is in the high beam light distribution pattern PH and which overlaps another vehicle(s) or a pedestrian(s). Thereby, while a possibility that glare is caused to the other vehicle(s) or pedestrian(s) can be reduced, driver's visibility can be improved. For example, the light shielded region S is formed in the following manner.

That is, the image processor 310 obtains image data captured by the imaging device 312 such as a camera and executes image processing for the image data. Thereby, the image processor 310 specifies a vehicle(s) and/or a pedestrian(s) included in the image data and detects a position(s) of the vehicle(s)/pedestrian(s). Technology to specify a vehicle(s) and a pedestrian(s) in image data and technology to detect a position of a vehicle/pedestrian have been known. Therefore, detailed description thereon will be omitted. Detected position data of the vehicle(s)/pedestrian(s) are transmitted to the controller 300. Using the position data of the vehicle(s)/pedestrian(s), the controller 300 controls the light deflector 30 so as to form a light shielded region(s) S at a position(s), in the high beam light distribution pattern PH, where the vehicle(s)/pedestrian(s) are present. Specifically, of the micro-mirror devices overlapping the first illuminance region R1, the light deflector 30 places micro-mirror devices corresponding to the light shielded region(s) S in the non-illumination state (for example, the OFF state). Thereby, the light shielded region(s) S are formed in the high beam light distribution pattern PH.

The exemplary embodiments have been described above. It should be noted that the invention is not limited thereto, but also includes appropriate combinations of the configurations of the exemplary embodiments and ones that are obtained by appropriately substituting a part of the configuration of each exemplary embodiment. Also, modifications to respective combinations of the exemplary embodiments, appropriate changes to the sequence of processing, and various design changes, etc., may be applied to the exemplary embodiment based on the knowledge of one skilled in the art to which the invention is relevant. Embodiments to which such modifications are applied may also be included in the scope of the invention.

In the exemplary embodiment, each of the micro-mirror devices making up the micro-mirror array of the light deflector includes the pivot which extends in the horizontal direction and which substantially bisects each micro-mirror device. Instead of this pivot, each of the micro-mirror devices making up the micro-mirror array may include a pivot that connects opposing apexes of each square-shaped mirror device. In this case, the light deflector is inclined about 45° so that the pivots of the micro-mirror devices are approximately horizontal. Thereby, the resultant light deflector may be used in the exemplary embodiments.

What is claimed is:

1. A vehicle headlamp comprising:

a light source;

a projection optical member that projects light, which is incident thereon, ahead of a lamp unit; and a light deflector that is disposed on an optical axis of the projection optical member and that includes a plurality of optical devices which are arrayed and which are individually switchable between (i) a first state in which light emitted from the light source is reflected to a direction other than a direction toward the projection optical member and (ii) a second state in which the light emitted from the light source is reflected toward the projection optical member, wherein an angle between a normal line to a center portion of each optical device when each optical device is in the first state and the optical axis of the projection optical member is smaller than an angle between a normal line to the center portion of each optical device when each optical device is in the second state and the optical axis of the projection optical member, wherein a length of the projection optical member in a first direction in which the light reflected by the optical devices moves when the optical devices are switched between the first state and the second state is shorter than that of the projection optical member in a second direction that is perpendicular to the first direction, the first and second directions being substantially perpendicular to a thickness direction of the projection optical member, and wherein the light deflector including the plurality of optical devices is inclined toward the projection optical member in the same direction as each optical device inclined in the second state.

2. The vehicle headlamp according to claim 1, wherein the light source is disposed below the optical axis of the projection optical member.

3. The vehicle headlamp according to claim 1, further comprising:

a reflective optical member that is disposed below the optical axis of the projection optical member and that reflects the light emitted from the light source toward the light deflector, wherein the reflective optical member is closer to the light deflector than the projection optical member.

4. The vehicle headlamp according to claim 2, further comprising:

a reflective optical member that is disposed below the optical axis of the projection optical member and that reflects the light emitted from the light source toward the light deflector, wherein the reflective optical member is closer to the light deflector than the projection optical member.

* * * * *